US009664367B2

(12) United States Patent
Wydotis et al.

(10) Patent No.: US 9,664,367 B2
(45) Date of Patent: May 30, 2017

(54) LEVEL CROSSING LIGHT PANEL

(71) Applicant: Siemens Industry, Inc., Alpharetta, GA (US)

(72) Inventors: Leonard Wydotis, Louisville, KY (US); Richard C. Bohme, Louisville, KY (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 217 days.

(21) Appl. No.: 14/516,757

(22) Filed: Oct. 17, 2014

(65) Prior Publication Data

US 2016/0108590 A1 Apr. 21, 2016

(51) Int. Cl.

| | |
|---|---|
| ***F21V 21/116*** | (2006.01) |
| ***B61L 5/18*** | (2006.01) |
| ***F21V 23/06*** | (2006.01) |
| ***H01R 33/92*** | (2006.01) |
| *F21W 111/02* | (2006.01) |
| *F21Y 101/00* | (2016.01) |

(52) U.S. Cl.

CPC ..... *F21V 23/06* (2013.01); *B61L 5/1872* (2013.01); *F21V 21/116* (2013.01); *H01R 33/92* (2013.01); *B61L 2207/02* (2013.01); *F21W 2111/02* (2013.01); *F21Y 2101/00* (2013.01)

(58) Field of Classification Search

CPC ..... E01F 9/00; E01F 9/016; E01F 9/60; E01F 9/602; E01F 9/604; E01F 9/608; E01F 9/61; E01F 9/615; E01F 9/617; E01F 9/619; E01F 9/623; E01F 9/658; E01F 9/662; E01F 9/673; F21S 8/08; F21S 8/081; F21S 8/085; F21S 8/086; F21S 8/088; F21V 23/06; F21V 21/116; B61L 5/1872; H01R 33/92

See application file for complete search history.

(56) References Cited

U.S. PATENT DOCUMENTS

2001/0054970 A1* 12/2001 Jones ..... G08G 1/0955 340/915
2009/0268451 A1* 10/2009 Zheng ..... F21K 9/00 362/235
2010/0315252 A1* 12/2010 Desphande ..... F21S 8/088 340/670

* cited by examiner

*Primary Examiner* — Andrew Coughlin
*Assistant Examiner* — Nathaniel Lee

(57) ABSTRACT

A level crossing panel may comprise a frame, a lighting module coupled to the frame, and a connection support coupled to the frame and electrically connected to the lighting module. The connection support may comprise an interface configured to be removably coupled to a connector of a mast and an electrical contact configured to transmit power from the connector of the mast to the lighting module.

29 Claims, 9 Drawing Sheets

LEVEL CROSSING LIGHT PANEL

BACKGROUND

Highway railroad crossings often include incandescent housings that contain a lamp bracket with an incandescent bulb, a parabolic reflector, and mounting hardware to secure these parts and focus the light from the bulb. Some crossings may be upgraded to use light emitting diode (LED) light engine technology, where LEDs are housed in independent modules design to be installed into the existing incandescent housings. All of the incandescent hardware is removed, and the LED module is put in its place.

A typical incandescent assembly contains an aluminum junction box that mounts to the signal mast, up to four cast aluminum arms used to offset the incandescent light heads for alignment, threaded elbows to provide rotational adjustment, and a parabolic shaped aluminum housing that is suspended from each extension arm. This assembly weighs an average of 26 pounds and is therefore unsuitable for raising from the ground level using a telescopic mounting tool. The assembly is also typically bolted to a mast 17 feet above a roadway, and therefore cannot be secured from the ground level. Furthermore, the entire aluminum junction box and cross arm assembly is very expensive and provides no value once LED modules are installed because the light spread on an LED unit is superior to that of an incandescent light source, so the LEDs may not need the rotational alignment provided by the assembly for incandescent bulbs.

BRIEF DESCRIPTIONS OF THE DRAWINGS

DETAILED DESCRIPTION OF SEVERAL EMBODIMENTS

Systems and methods described herein may provide a light weight solution to applying LEDs to level crossings while allowing railroad personnel the ability to install and maintain the units from ground level and avoid the risks associated with climbing signal structures. The LED modules described herein may supplement or replace incandescent lamp housings, rather than being retrofitted into the housings.

The flashing light LED panel may be a self-contained electrical unit that may include a mounting panel, two 10 or 12 inch diameter LED lamp modules, and an apparatus to pivot the LED modules to align with the roadways. A tool to physically and electrically mount the panel to a structure (such as a 5 in diameter aluminum mast or overhead cantilever structure, for example) from the ground level without having to climb a cantilever or bridge-type structure to secure it in place may also be provided. The panel may be configured to provide a similar level of anti-phantom (stray light) protection as current flashing light backgrounds and hoods. The electrical connection of the panel may utilize spring-loaded copper contacts to provide power to the LEDs while also mechanically mounting the panel using a tongue and groove-type interlock to keep the panel in place. As an alternative to the physical spring-loaded contacts, the light panel may be inductively coupled to the base with no exposed electrical connections.

Figure 1A:
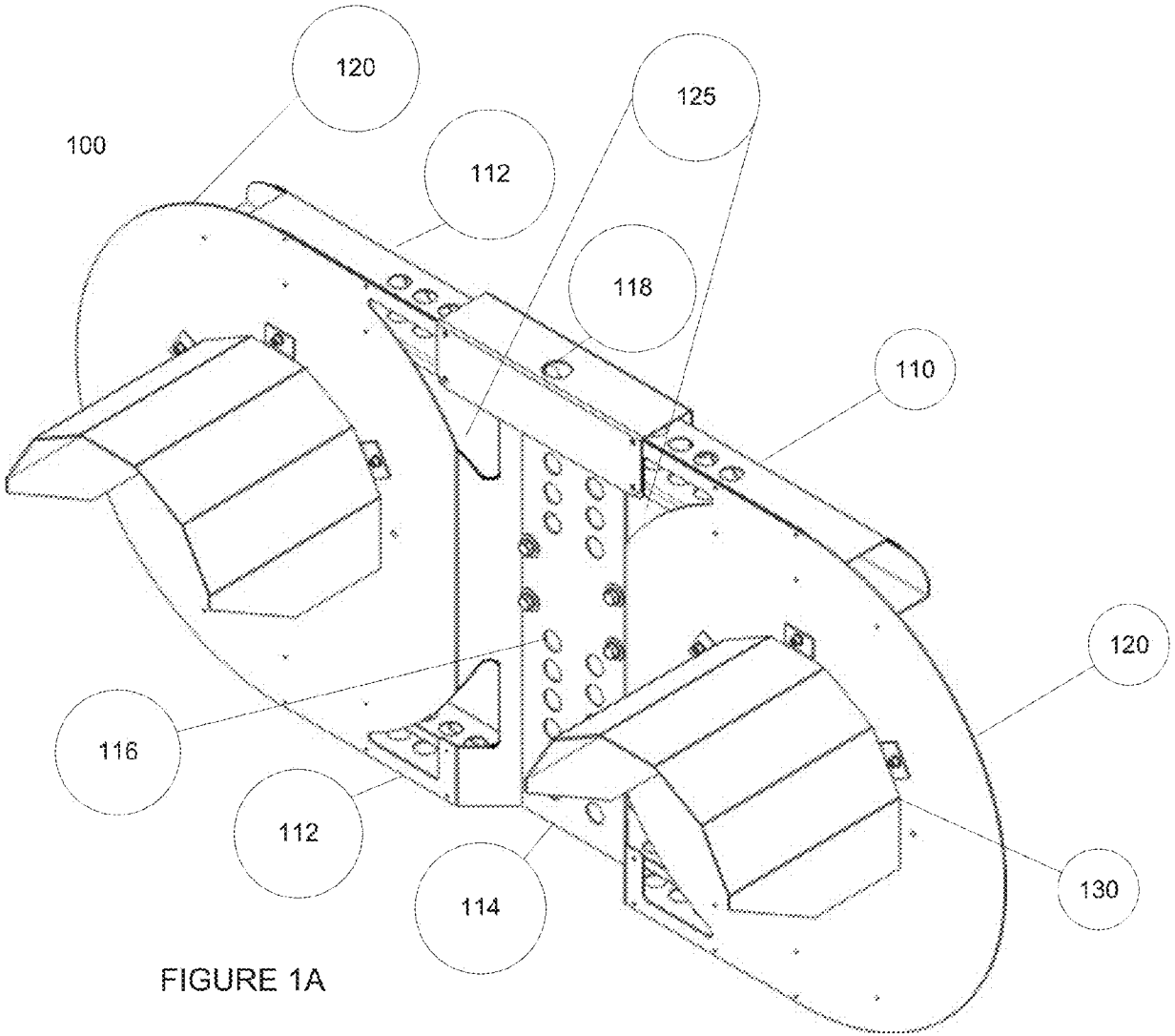
FIG. 1A is a perspective view of the front of a level crossing LED panel according to an embodiment of the invention.
Figure 1B:
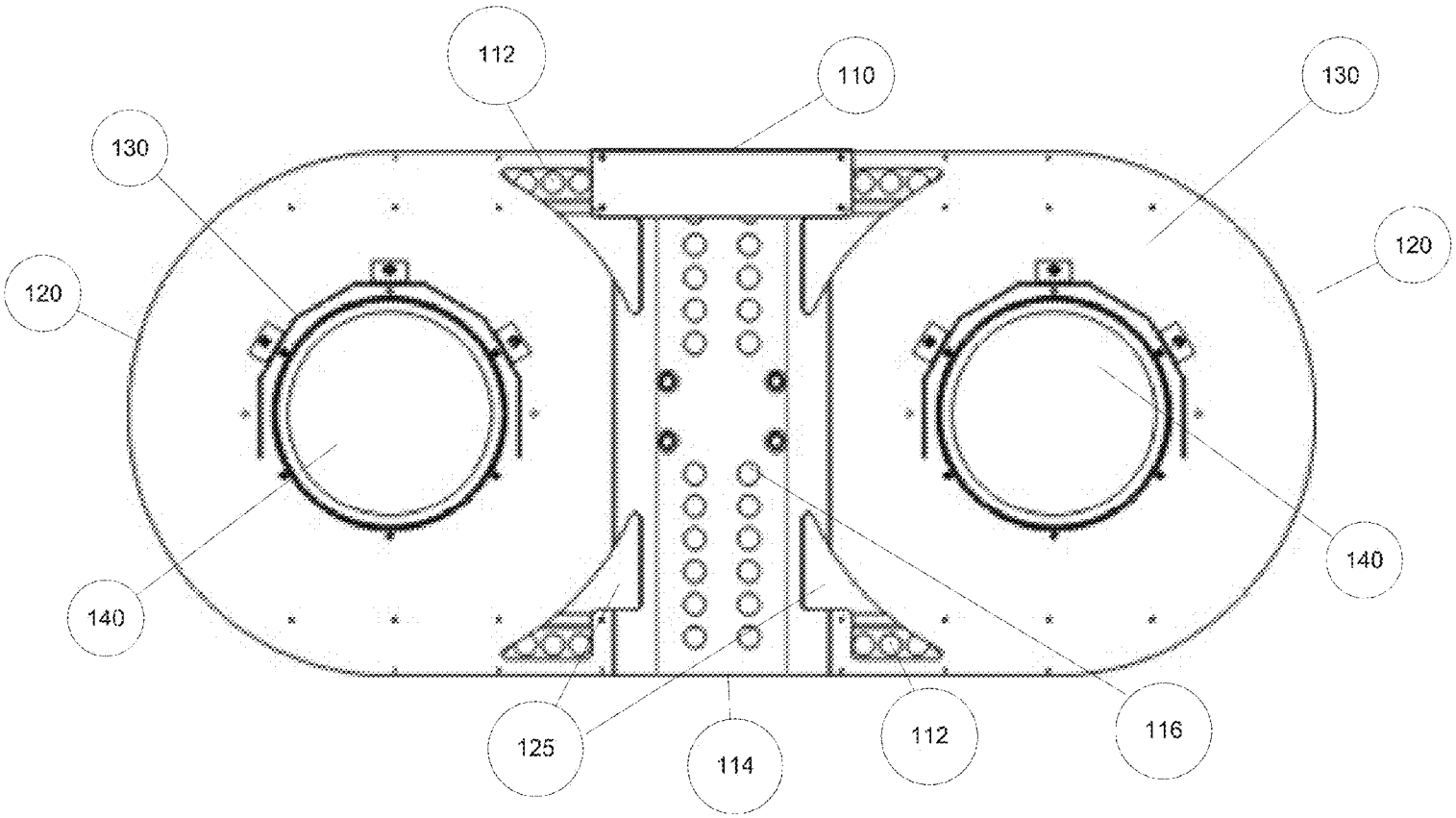
FIG. 1B is an elevation view of the front of a level crossing LED panel according to an embodiment of the invention.

FIG. 1A is a perspective view, and FIG. 1B is an elevation view, of the front of a level crossing LED panel 100 according to an embodiment of the invention. The panel 100 may include a frame 110. The frame 110 may provide structural support and frontal wind deflection resistance for the panel 100. The frame 110 may also provide a bearing surface for lifting during installation as described in greater detail below. The frame 110 may be made from any suitable material, such as aluminum or lightweight molded plastic. The example frame 110 of FIGS. 1A and 1B is an H-frame, with two horizontal sections 112 and a vertical section 114 connecting the horizontal sections 112. The frame 110 may include cutouts 116 to reduce weight and/or surface area to prevent wind damage. The frame 110 may also include a lifting hole 118 into which a lifting tool may be inserted for lifting the panel 100, as described in greater detail below. The panel 100 may include a background 120 attached to the frame 110. The background 120 may be made of any suitable material, for example sheet metal or lightweight plastic. The background 120 may include cutouts 125 to reduce weight and/or surface area to prevent wind damage. The panel 100 may include at least one LED module 140. Each LED module 140 may be provided with a visor 130, which may shield the LED module 140, for example to prevent glare. Visors 130 may be made of any suitable material, such as sheet metal or lightweight plastic. Visors 130 may be attached to the background 120 in any suitable way, such as clips, standard hardware, and/or PEM nuts. For example, a level crossing may include two LED modules 140 and two associated visors 130. Note that while LED modules 140 are shown in this embodiment, other light sources may be used in place of or in addition to LEDs.

Figure 2A:
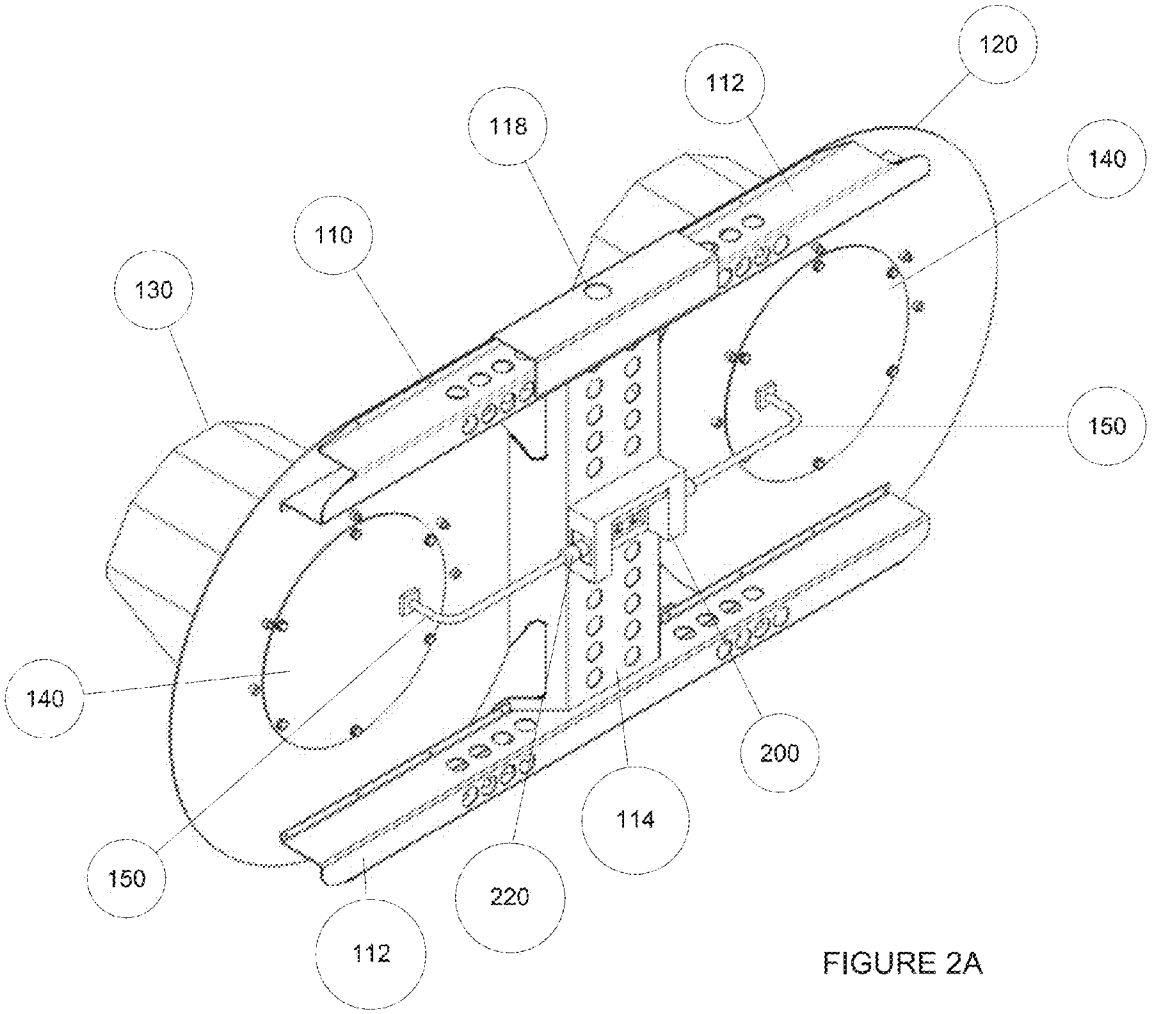
FIG. 2A is a perspective view of the rear of a level crossing LED panel according to an embodiment of the invention.
Figure 2B:
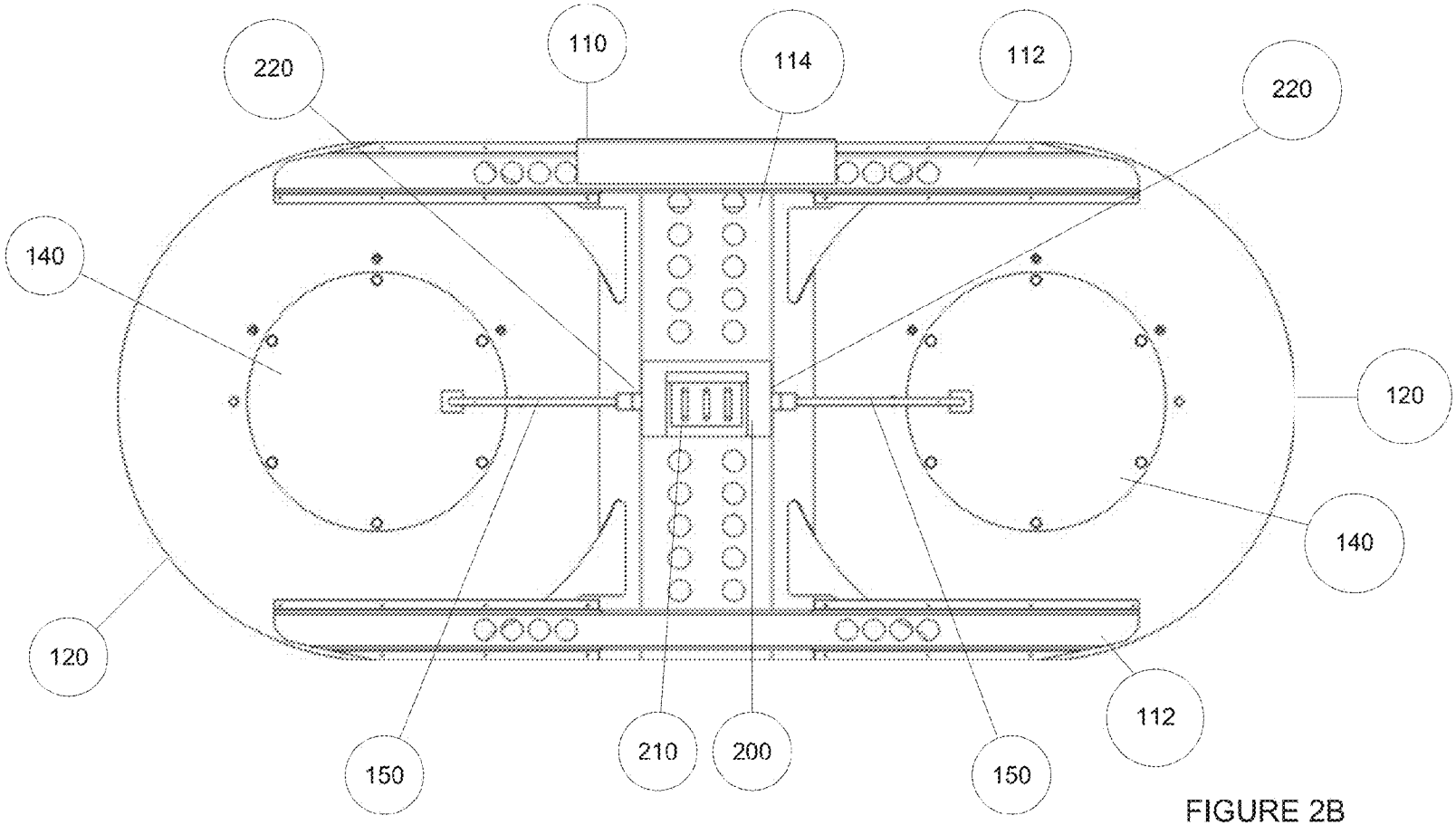
FIG. 2B is an elevation view of the rear of a level crossing LED panel according to an embodiment of the invention.

FIG. 2A is a perspective view, and FIG. 2B is an elevation view, of the rear of the level crossing LED panel 100 of FIG. 1. A connection support 200 may be provided on the rear of the panel 100, for example on the vertical section 114 of the frame 110. As described in greater detail below, the connection support 200 may provide a mechanical attachment of the panel 100 to a mast connector on a mast. The connection support 200 may include one or more electrical contacts 210 which may electrically connect the panel 100 to electrical elements in the mast. The connection support 200 may also include electrical connections 220 which may connect to electrical connectors 150. One or more electrical connectors 150, for example a multi-conductor pigtail assembly, may couple the connection support 200 to the LED module 140 to supply power and/or control signals to the LED module 140. As described in greater detail below, the contacts 210 and mechanical attachment provided by the connection support 200 may allow the panel 100 to be attached and/or removed from a mast without disconnecting wires. This may speed installation and/or removal and may allow panel 100 maintenance without climbing a ladder to connect or disconnect wires.

Figure 3:
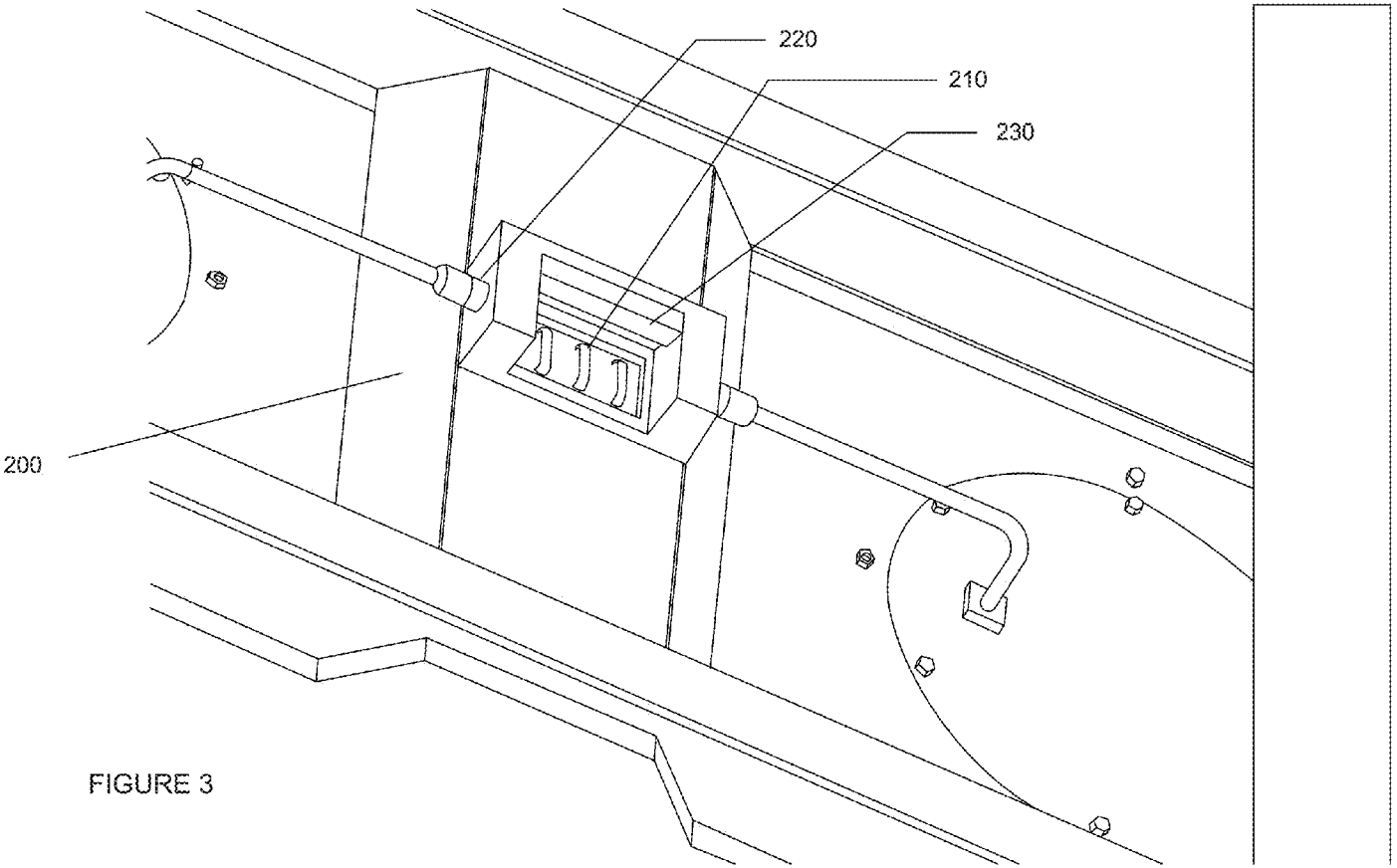
FIG. 3 is a perspective view of a connection support according to an embodiment of the invention.

FIG. 3 is a perspective view of a connection support 200 according to an embodiment of the invention. As seen in this view, the connection support 200 may include an electrical contact 210 for each LED module 140 and a ground contact 210. Thus, in the example panel 100 with two LED modules 140 shown, three contacts 210 are provided. The connection support 200 may include an interface such as a locking notch 230, which may be used to couple the connection support 200 to a mast connector, as described in greater detail below.

Figure 4:
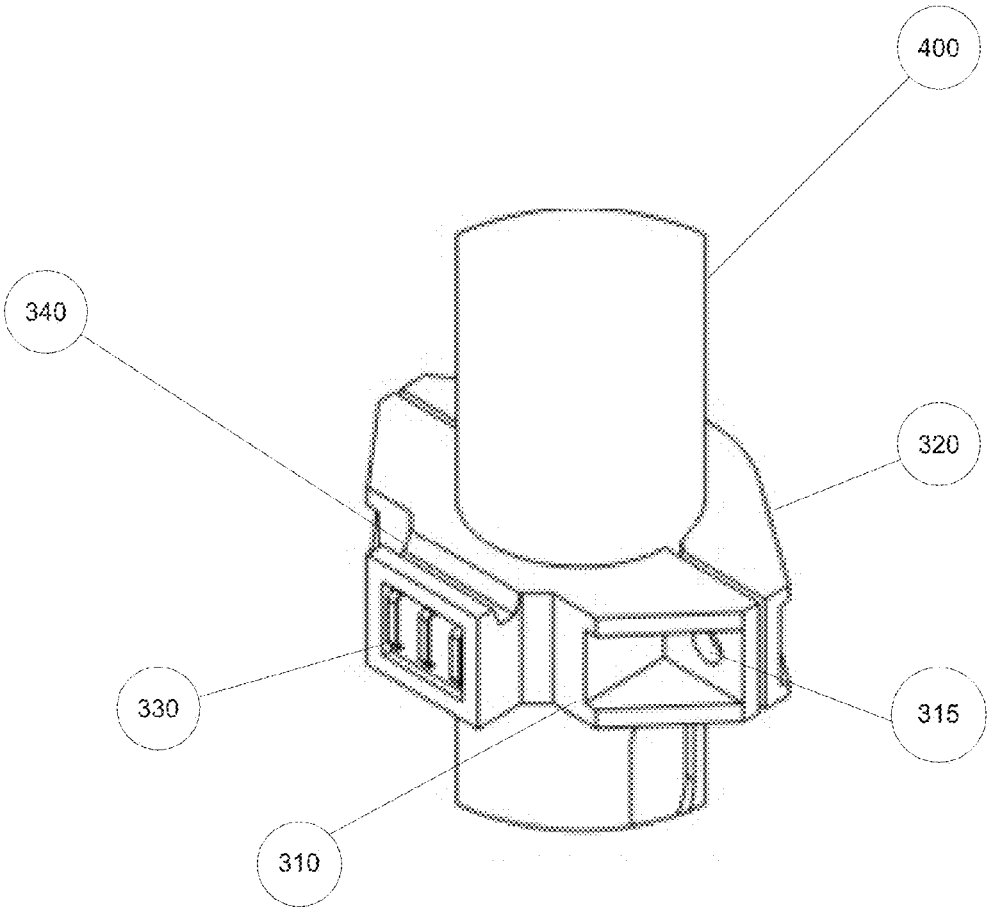
FIG. 4 is a perspective view of a mast connector assembly according to an embodiment of the invention.

FIG. 4 is a perspective view of a mast connector assembly 300 according to an embodiment of the invention. The mast connector assembly 300 may be mounted to a mast 400, for example a 5" diameter pipe mast. The mast connector assembly 300 may include a mast connector 310 and bracket 320, which may be fitted around the mast 400 and attached to one another. For example, the mast connector 310 and bracket 320 may each have an inner circumference corresponding to an outer circumference of the mast 400. The mast connector 310 and bracket 320 may be fitted around the mast 400 and bolted together with two bolts (not shown) inserted in holes in the mast connector 310 and bracket 320 (e.g., hole 315, a corresponding hole in the bracket 320 not visible in FIG. 4, and similar holes on the opposite side of the mast connector 310 and bracket 320 not visible in FIG. 4).

The mast connector 310 may include a set of contacts 330 which may be mated to the contacts 210 of the connection support 200. For example, the mast connector 310 may include an electrical contact 330 for each LED module 140 of the panel 100 and a ground contact 330.

The mast connector 310 may include a locking notch 340. The locking notch 340 of the mast connector 310 may be shaped to mate with the connection support 200, and the locking notch 230 of the connection support 200 may be shaped to mate with the mast connector 310, in a tongue and groove arrangement. When the panel 100 is installed, the connection support 200 may be lifted to the mast connector assembly 300, the locking notch 230 of the connection support 200 may be mated with the mast connector 310, and the locking notch 340 of the mast connector 310 may be mated with the connection support 200. This may secure the panel 100 in place such that the contacts 210 of the connection support 200 are electrically coupled to the contacts 330 of the mast connector 310.

Figure 5:
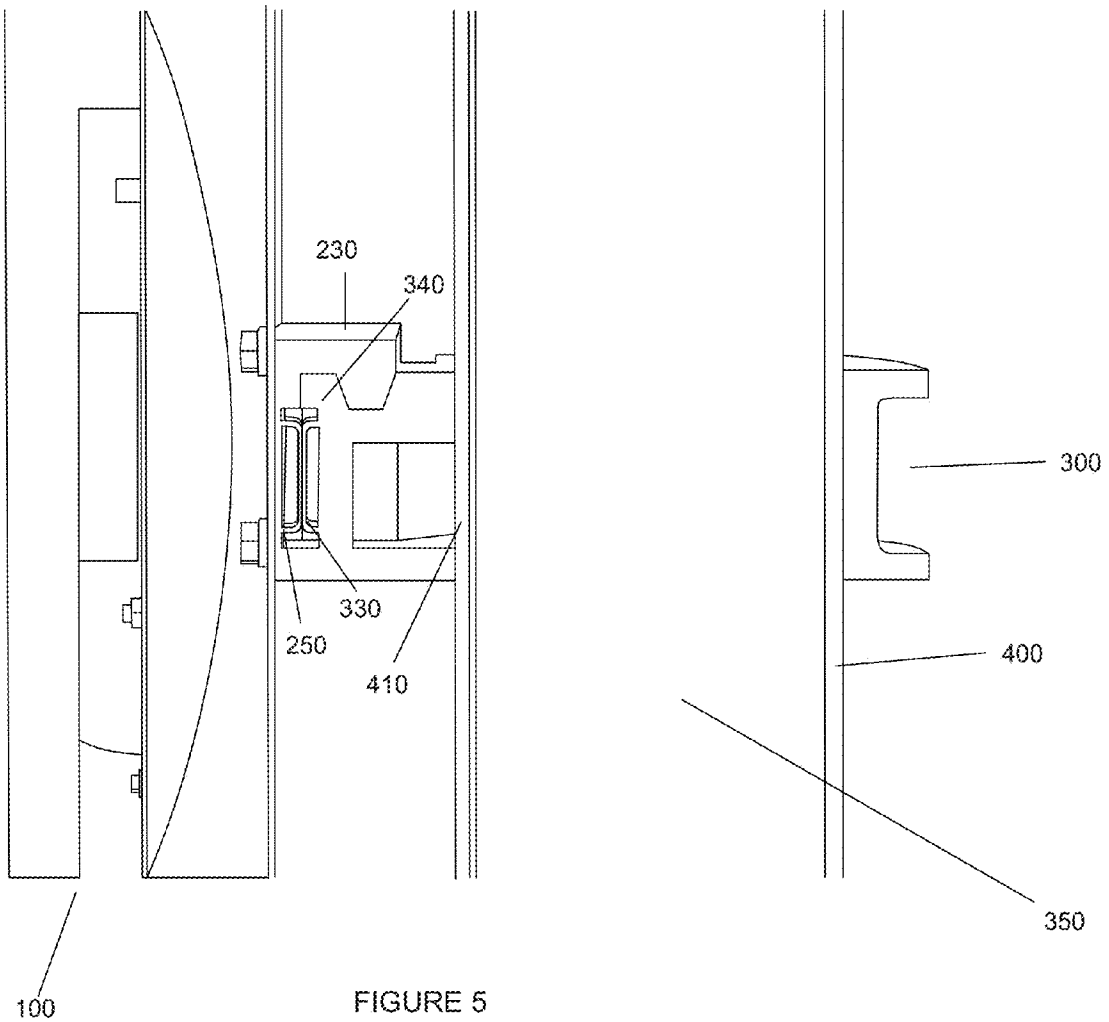
FIG. 5 is a cutaway view of a mast connector assembly and LED panel according to an embodiment of the invention.

FIG. 5 is a cutaway view of the mast connector assembly 300 and LED panel 100 according to an embodiment of the invention. The locking notch 230 of the connection support 200 and the locking notch 340 of the mast connector 310 may fit together in a tongue and groove arrangement as shown or in some other arrangement that allows the connection support 200 to be securely fitted to the mast connector 310. Mating the connection support 200 and mast connector 310 may place the contacts 210 of the connection support 200 and the contacts 330 of the mast connector 310 into electrical contact with one another. The contacts 330 of the mast connector assembly 300 may be coupled to wires 350 inside the mast connector 310 which may run from the inside of the mast connector 310 into a hole 410 in the mast 400, through the mast 400, and into an electrical junction box at the bottom of the mast 400 (not shown). Thus, power and/or control signals may be supplied to the LED modules 140 of the panel 100 from the junction box through the mated contacts 210/330.

Figure 6:
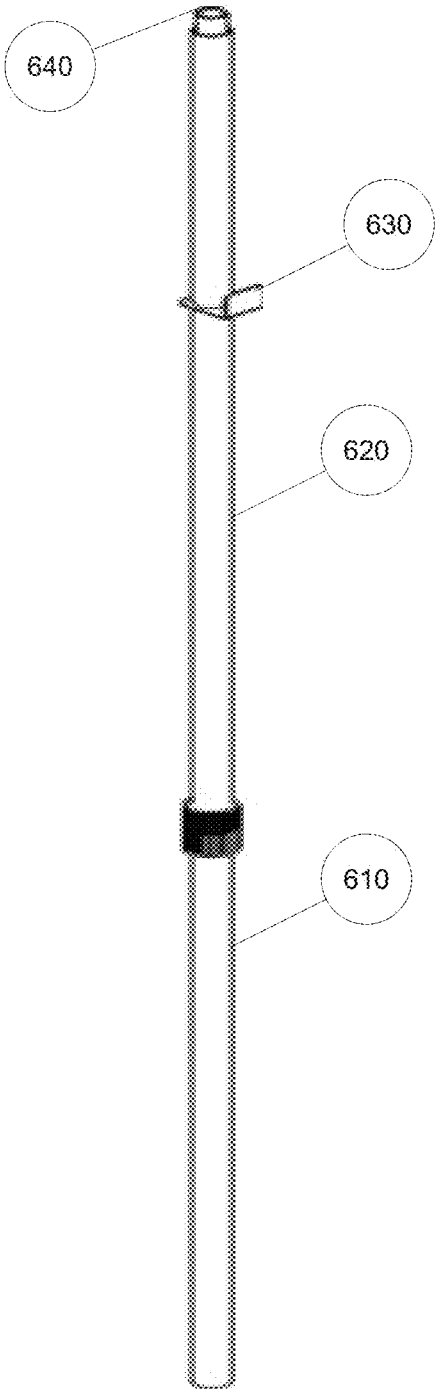
FIG. 6 is a perspective view of a lifting tool according to an embodiment of the invention.
Figure 7:
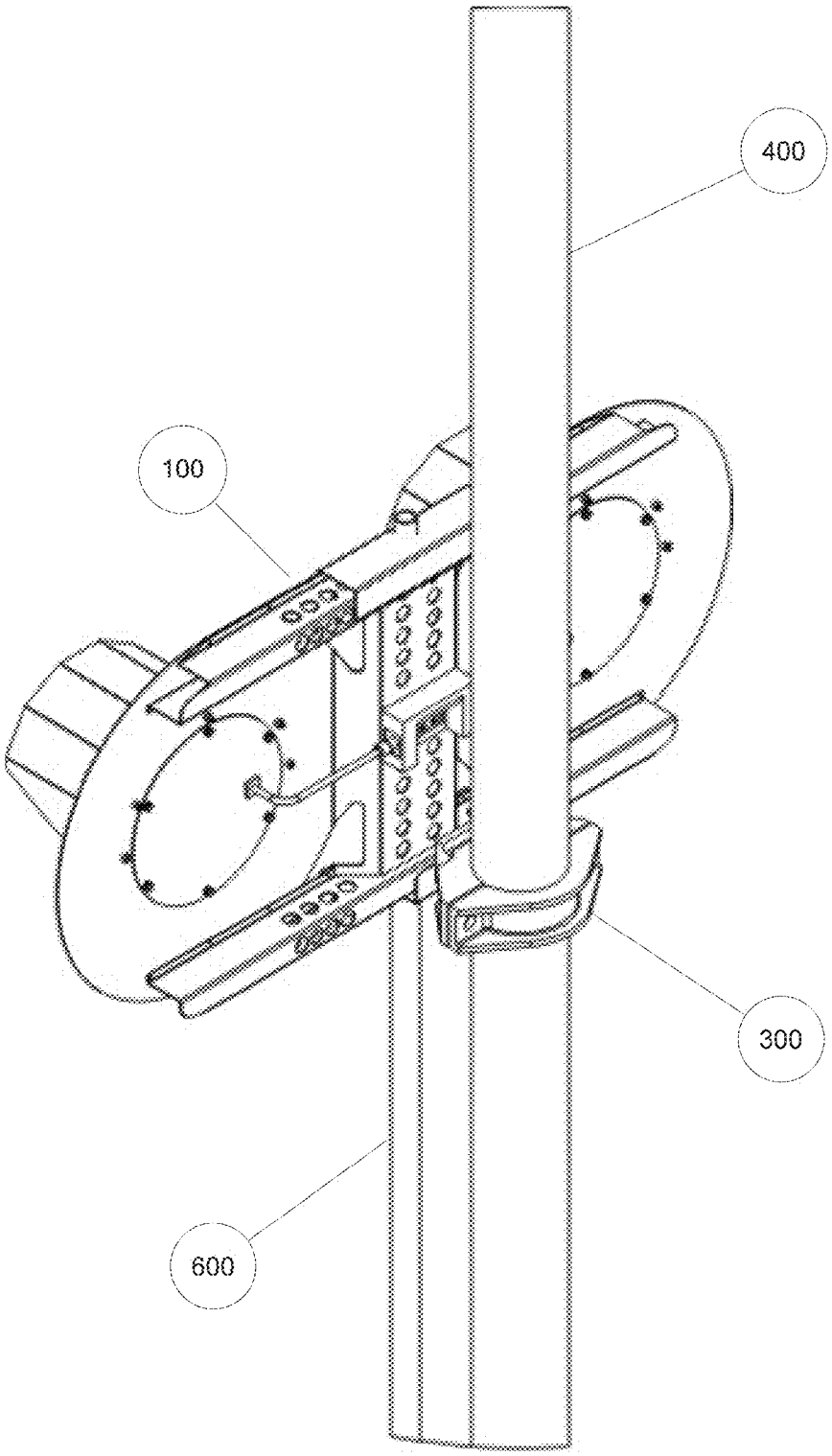
FIG. 7 is a perspective view of a lifting tool engaged with a level crossing LED panel according to an embodiment of the invention.

FIG. 6 is a perspective view of a lifting tool 600 according to an embodiment of the invention. The lifting tool 600 may include a lower section 610 and an upper section 620 which may telescope, for example with the upper section 620 fitting inside the lower section 610. The lower section 610 may also serve as a handle for a user. A lifting bracket 630 and tool pilot 640 may be disposed on the upper section 620. The lifting bracket 630 may engage the panel 100 at the bottom of the frame 110 to provide stability, while the tool pilot 640 may be inserted into the lifting hole 118. FIG. 7 is a perspective view of a lifting tool 600 engaged with a level crossing LED panel 100 according to an embodiment of the invention. A user may engage the tool 600 with the panel 100 and lift the panel to a mast connector assembly 300 mounted high on a mast 400, as shown in FIG. 7.

While various embodiments have been described above, it should be understood that they have been presented by way of example and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments.

In addition, it should be understood that any figures which highlight the functionality and advantages are presented for example purposes only. The disclosed methodology and system are each sufficiently flexible and configurable such that they may be utilized in ways other than that shown.

Although the term "at least one" may often be used in the specification, claims and drawings, the terms "a", "an", "the", "said", etc. also signify "at least one" or "the at least one" in the specification, claims and drawings.

Finally, it is the applicant's intent that only claims that include the express language "means for" or "step for" be interpreted under 35 U.S.C. 112(f). Claims that do not expressly include the phrase "means for" or "step for" are not to be interpreted under 35 U.S.C. 112(f).

What is claimed is:

1. A level crossing panel comprising:

a frame;

a lighting module coupled to the frame; and a connection support coupled to the frame and electrically connected to the lighting module, the connection support comprising an interface configured to be removably coupled to a connector of a mast and an electrical contact configured to transmit power from the connector of the mast to the lighting module, wherein the connection support interface comprises a locking notch configured to mate with the connector of the mast to removably couple the connection support to the connector of the mast.

2. The level crossing panel of claim 1, wherein the frame is an H-frame comprising a pair of horizontal sections and a vertical section coupled to each of the horizontal sections.

3. The level crossing panel of claim 1, wherein the frame comprises a lifting hole configured to be removably coupled to a lifting tool.

4. The level crossing panel of claim 1, wherein the frame is made of aluminum or plastic.

5. The level crossing panel of claim 1, further comprising a background coupled to the frame.

6. The level crossing panel of claim 5, wherein the background couples the lighting module to the frame.

7. The level crossing panel of claim 5, wherein the background is made of sheet metal or plastic.

8. The level crossing panel of claim 1, further comprising a visor arranged to shield a light emitting portion of the lighting module from glare.

9. The level crossing panel of claim 1, wherein the lighting module comprises a light emitting diode (LED).

10. The level crossing panel of claim 1, further comprising an electrical connector electrically connecting the connection support and the lighting module.

11. The level crossing panel of claim 1, wherein the locking notch is configured to mate with the connector of the mast in a tongue and groove fashion.

12. The level crossing panel of claim 1, wherein the connector of the mast comprises a mast connector interface configured to be removably coupled to the connection support, the mast connector interface comprising a locking notch, wherein the connection support and the connector of the mast are removably coupled to one another by mating of the locking notch of the connection support interface to the mast connector interface and mating of the locking notch of the mast connector interface to the connection support interface.

13. A level crossing panel lifting tool comprising:

a telescoping handle comprising a lower section and an upper section configured to telescope within the lower section;

a lifting bracket configured to engage with a frame of a level crossing panel; and a tool pilot configured to engage with a lifting hole of the frame.

14. A level crossing signal system comprising:

a mast connector assembly configured to be coupled to a mast, the mast connector assembly comprising:

a mast connector comprising an interface configured to be removably coupled to a connection support of a level crossing panel; and an electrical contact electrically connected to a power source; and the level crossing panel comprising:

a frame;

a lighting module coupled to the frame; and the connection support coupled to the frame and electrically connected to the lighting module, the connection support comprising an interface configured to be removably coupled to the mast connector and an electrical contact configured to electrically contact the electrical contact of the mast connector assembly to transmit power from the power source to the lighting module, wherein the connection support interface comprises a locking notch configured to mate with the mast connector interface to removably couple the connection support to the mast connector.

15. The level crossing signal system of claim 14, wherein the mast connector assembly further comprises a bracket configured to be removably coupled to the mast connector so that the bracket and mast connector are fastened to the mast by the coupling of the bracket to the mast connector.

16. The level crossing signal system of claim 14, further comprising the mast.

17. The level crossing signal system of claim 14, further comprising the power source.

18. The level crossing signal system of claim 14, wherein the frame is an H-frame comprising a pair of horizontal sections and a vertical section coupled to each of the horizontal sections.

19. The level crossing signal system of claim 14, wherein the frame comprises a lifting hole configured to be removably coupled to a lifting tool.

20. The level crossing signal system of claim 14, wherein the frame is made of aluminum or plastic.

21. The level crossing signal system of claim 14, further comprising a background coupled to the frame.

22. The level crossing signal system of claim 21, wherein the background couples the lighting module to the frame.

23. The level crossing signal system of claim 21, wherein the background is made of sheet metal or plastic.

24. The level crossing signal system of claim 14, further comprising a visor arranged to shield a light emitting portion of the lighting module from glare.

25. The level crossing signal system of claim 14, wherein the lighting module comprises a light emitting diode (LED).

26. The level crossing signal system of claim 14, further comprising an electrical connector electrically connecting the connection support and the lighting module.

27. The level crossing signal system of claim 14, wherein:

the mast connector interface comprises a locking notch configured to mate with the connection support interface; and the connection support and mast connector are removably coupled to one another by mating of the locking notch of the connection support interface to the mast connector interface and mating of the locking notch of the mast connector interface to the connection support interface.

28. The level crossing signal system of claim 27, wherein:

the locking notch of the connection support interface is configured to mate with the mast connector interface in a tongue and groove fashion; and the locking notch of the mast connector interface is configured to mate with the connection support interface in a tongue and groove fashion.

29. The level crossing signal system of claim 14, further comprising a level crossing panel lifting tool comprising:

a telescoping handle comprising a lower section and an upper section configured to telescope within the lower section;

a lifting bracket configured to engage with the frame of a level crossing panel; and a tool pilot configured to engage with a lifting hole of the frame.

* * * * *